US005484109A

United States Patent [19]

Cook

[11] Patent Number: 5,484,109

[45] Date of Patent: Jan. 16, 1996

[54] GLASS SHEARING APPARATUS

[76] Inventor: Donald E. Cook, 4335 Roberts Lake Trail, Faribault, Minn. 55021

[21] Appl. No.: 124,303

[22] Filed: Sep. 20, 1993

[51] Int. Cl.[6] ..... B02C 23/16; B02C 19/14; B02C 13/02

[52] U.S. Cl. ..... 241/73; 241/99; 241/152.2; 241/189.1; 241/242

[58] Field of Search ..... 241/73, 86, 99, 241/152.2, 189.1, 189.2, 189.3, 242

[56] References Cited

U.S. PATENT DOCUMENTS

| | | | |
|---|---|---|---|
| 980,048 | 12/1910 | Bercha | 241/152.2 X |
| 3,655,138 | 4/1972 | Luscombe | 241/99 |
| 3,687,062 | 8/1972 | Frank . | |
| 3,713,596 | 1/1973 | Hoffman . | |
| 3,750,965 | 8/1973 | Madden et al. . | |
| 3,827,351 | 8/1974 | Rosenow . | |
| 3,847,361 | 11/1974 | Heger | 241/152.2 |
| 3,889,886 | 6/1975 | Spivey . | |
| 3,941,604 | 3/1976 | Boyce . | |
| 4,205,794 | 6/1980 | Horton et al. | 241/99 X |
| 4,309,204 | 1/1982 | Brooks . | |
| 4,312,655 | 1/1982 | Pack . | |
| 4,373,435 | 2/1983 | Grevich . | |
| 4,422,862 | 12/1983 | Wardlaw . | |
| 4,493,459 | 1/1985 | Buckett | 241/152.2 |
| 4,537,361 | 8/1985 | Heimerich . | |
| 4,867,384 | 9/1989 | Waltert . | |
| 4,904,293 | 2/1990 | Garnier et al. . | |
| 5,076,505 | 12/1991 | Petrocy . | |
| 5,165,610 | 11/1992 | Pendelton | 241/99 X |

*Primary Examiner*—Timothy V. Eley
*Attorney, Agent, or Firm*—Merchant, Gould, Smith, Edell, Welter & Schmidt

[57] ABSTRACT

An apparatus for shearing glass refuse such as bottles, containers, windshields, and the like into a glass aggregate. The apparatus comprises a rectangular housing having an inlet chute for loading glass, a Popper for initial breaking of the glass, a Breaker for shearing the glass into smaller pieces, and a Shearer for shearing the glass pieces into a glass aggregate. The glass aggregate is comprised of particles that are small, porous, and consistent enough in size such that it can be used as a filler in many products and also as a substitute for sand.

5 Claims, 7 Drawing Sheets

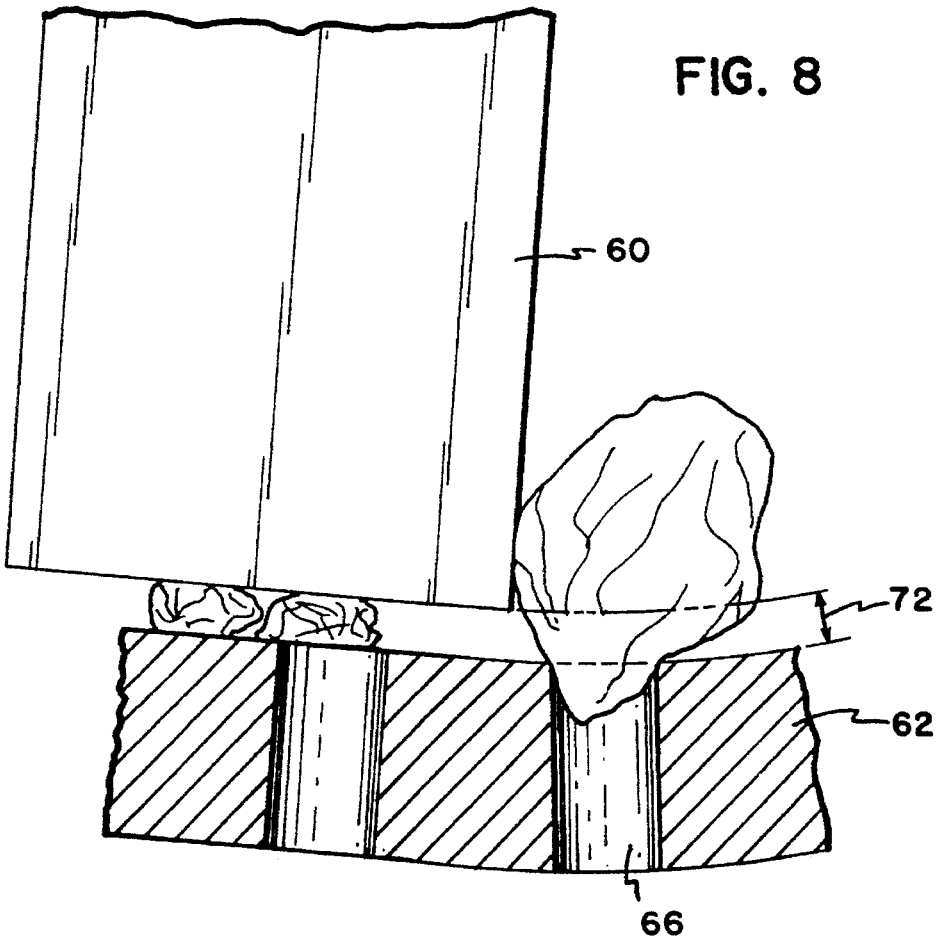
FIG. 8
FIG. 10
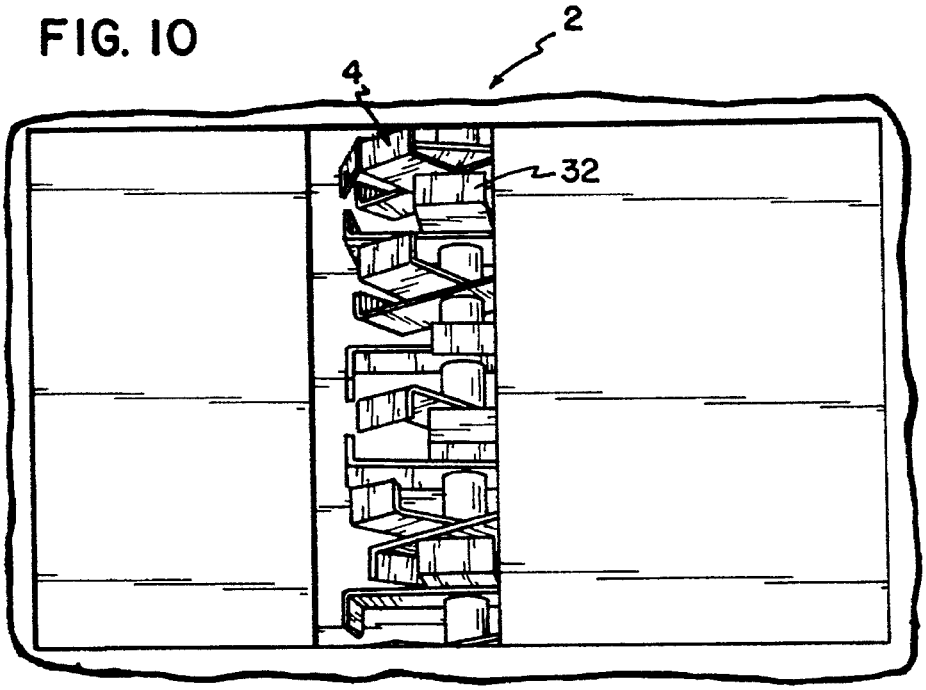

GLASS SHEARING APPARATUS

TECHNICAL FIELD OF THE INVENTION

The present invention relates in general to a device for breaking down glass, and more particularly to a device for shearing glass down to very fine particles as it passes through the present invention.

BACKGROUND OF THE INVENTION

Disposal and recycling of glass containers, bottles, windows, windshields, and the like is an ever increasing problem of many cities, and even small communities. For many cities, economical and environmentally safe dumping sites are very difficult to find. And, while some of these glass objects may be recycled, much of it ends up in landfills due to oversupply.

A number of machines have been developed for breaking glass objects into pieces for more compact disposal. One bottle crushing device is disclosed in U.S. Pat. No. 3,713,596 to William D. Hoffmann (issued Jan. 30, 1973). The Hoffman device crushes glass particles into successively smaller pieces by force feeding the particles through a tapered region having a rotating auger. Another bottle smasher is disclosed in U.S. Pat. No. 5,076,505 to Richard J. Petrocy (issued Dec. 31, 1991). The Petrocy device directs containers down a chute into the path of a rotating battering ram enclosed in a housing.

Although these machines smash and crush the glass into smaller sizes for the more efficient storing and disposal, the resulting glass is suitable only for refuse. The glass pieces produced by these machines are too large, lack consistency in size, have edges that are too sharp and surfaces that are too smooth, and lack a porousness desired for glass particles to be used as a filler in mixtures such as concrete or asphalt. As such, the glass product produced by these machines has limited or no utility.

SUMMARY OF THE INVENTION

The present invention provides an apparatus for processing glass refuse, such as, bottles, windshields, and the like into a glass aggregate. The apparatus comprises a rectangular housing having an inlet chute for loading glass, a Popper for initial breaking of the glass, a Breaker for shearing the glass into smaller pieces, and a Shearer for shearing the glass pieces into a glass aggregate. The glass aggregate is comprised of particles small and consistent enough in size and surface configuration such that it can be used as a filler in many products, as a substitute for sand, and other useful purposes. Thus, the present invention can convert glass refuse to a valuable product and eliminate such refuse from dump sites altogether.

In recent years, recycling has been used by many to reduce the amount of glass that has been accumulating in dumps. However, recycling is a very expensive process. On the other hand, the process performed on glass by the apparatus disclosed in the present invention eliminates the need for recycling and produces a product from glass at very little expense. The apparatus can take glass in an uncleaned state and shear it into an aggregate. The aggregate can be used in many commercially advantageous ways: sandblasting, ice melting, sure-grip for ice, mason mix, roofing material, shingling material, concrete, paving seal, and many other uses usually met by sand.

BRIEF DESCRIPTION OF THE DRAWINGS

FIG. 8 shows Shearer tines interacting with glass and screen holes to create fine sheared glass particles.

FIG. 10 is a top view of the Shearer illustrating the blades making up the Popper and the chute where glass is input.

DETAILED DESCRIPTION OF THE INVENTION

Figure 1:
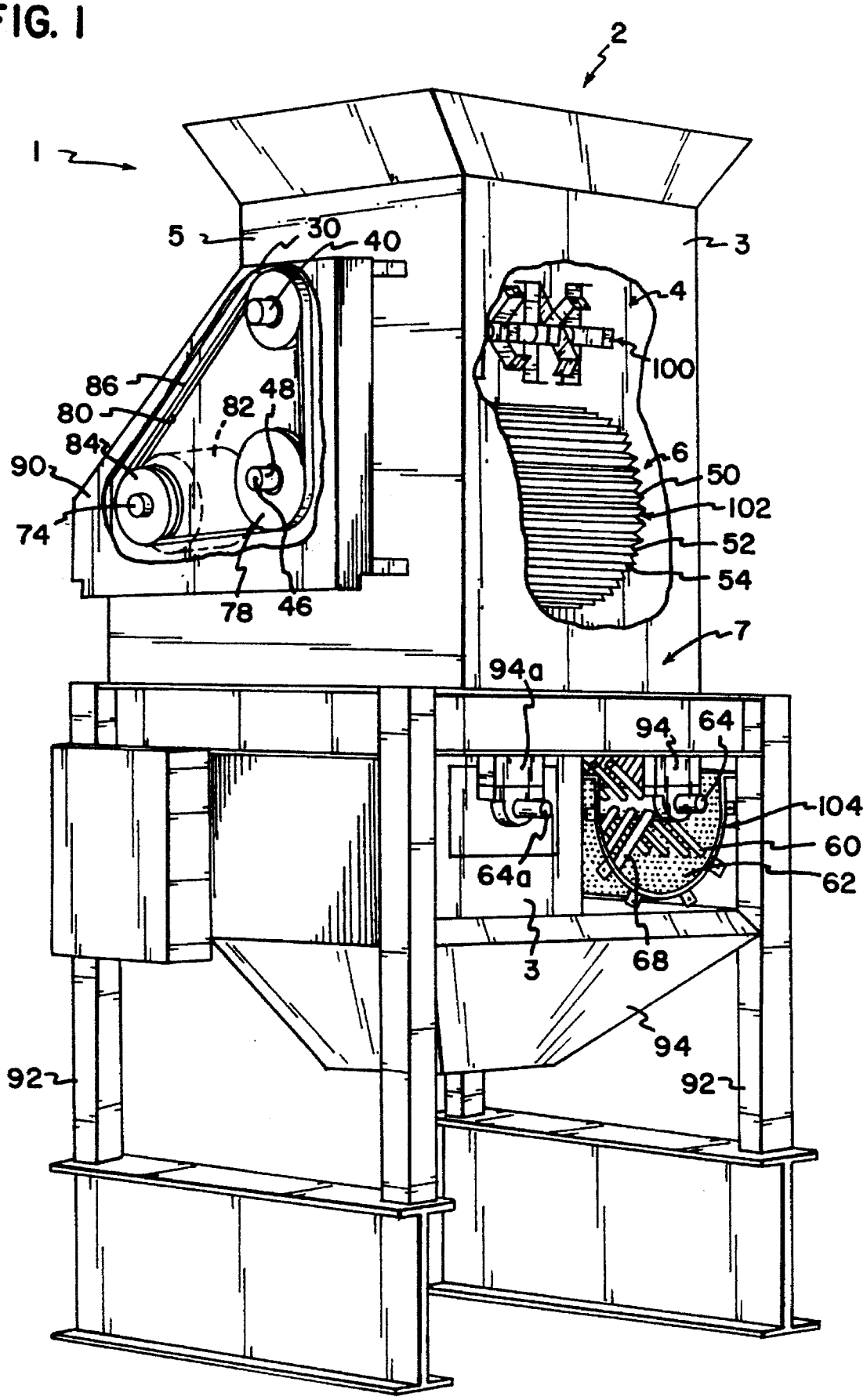
FIG. 1 is a perspective view showing the glass Shearer of the present invention with portions of the enclosure cut away for clarity.

Referring to FIG. 1, there is shown an apparatus for shearing glass 1 such as, bottles, windshields, and the like into a glass aggregate. The glass aggregate is comprised of particles small and consistent enough in size and surface composition such that it can be used as a filler in many products, as a substitute for sand, and for other useful purposes.

In accordance with the present invention, the apparatus for shearing glass 1 is housed in an enclosed cabinet 7 having a sidewall arrangement, including sidewalls 3 and 5, an open top end 2 and an open bottom end (not shown) under which is mounted a glass holder 94. The housing cabinet 7 is supported by a four legged base stand 92, that provides balance and stability to the apparatus while in operation.

Figure 2:
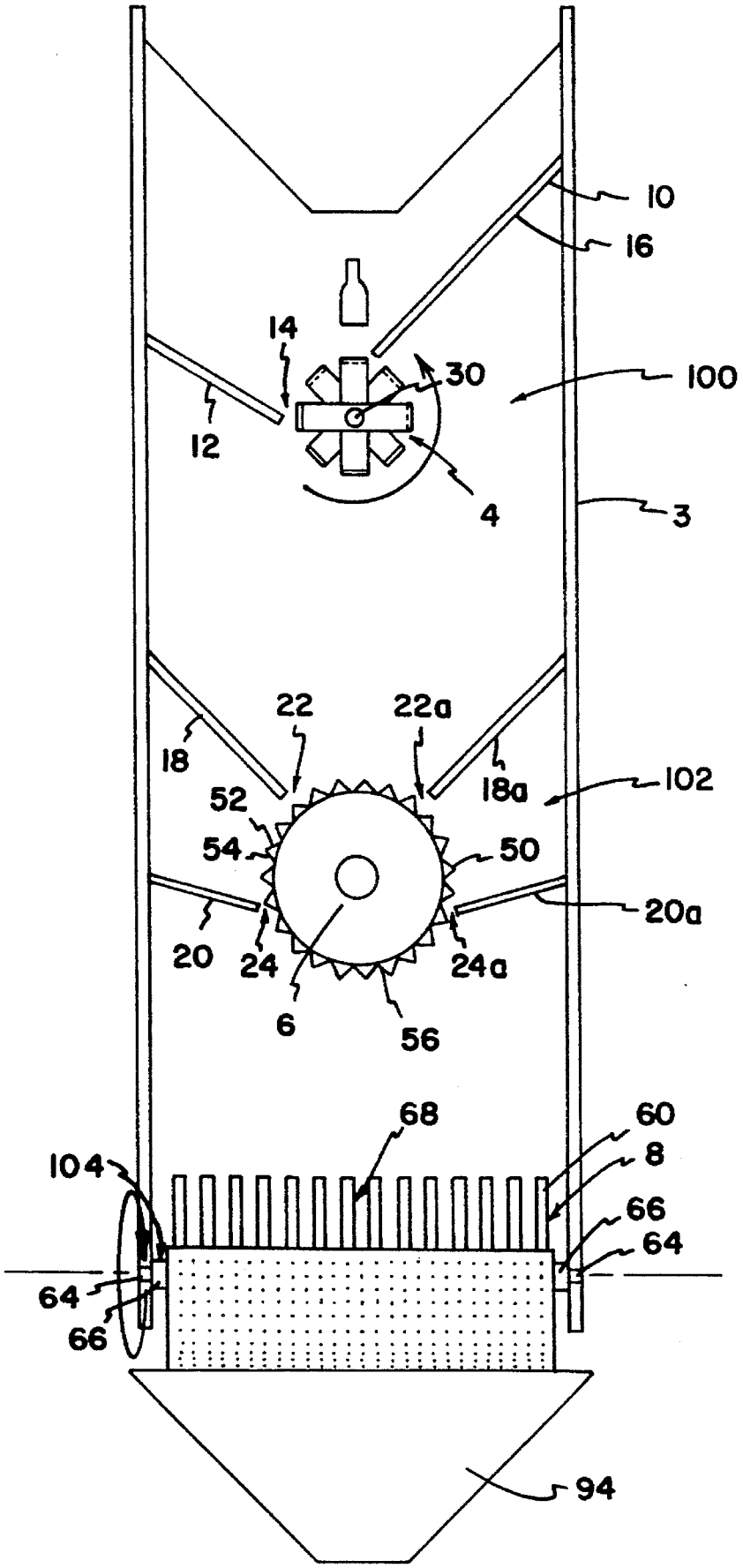
FIG. 2 shows the positioning of the Popper, Breaker and the Shearer in relation to one another.

The housing cabinet 7 may be formed of rectangular sheet metal. As illustrated in FIG. 2, the metal sheets are manipulated to form an elongated passage having three regions, a Popper region 100, a Breaker region 102, and a shearing region 104. There are no separators between the above mentioned regions. The broken glass falls from one region to the next, interacting with the components of each region.

The cabinet open top end 2 acts as an inlet chute allowing for the loading of glass. Glass loaded at end 2 falls into the Popper region 100, where it comes in contact with the Popper 4.

Figure 3:
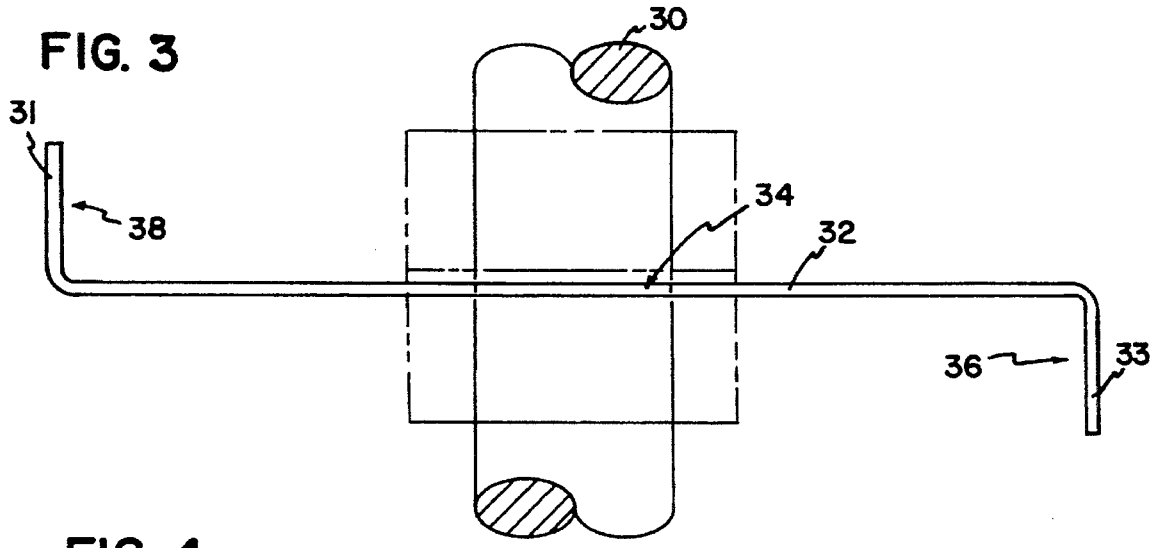
FIG. 3 is a vertical cross-section across the width of one Popper blade.
Figure 4:
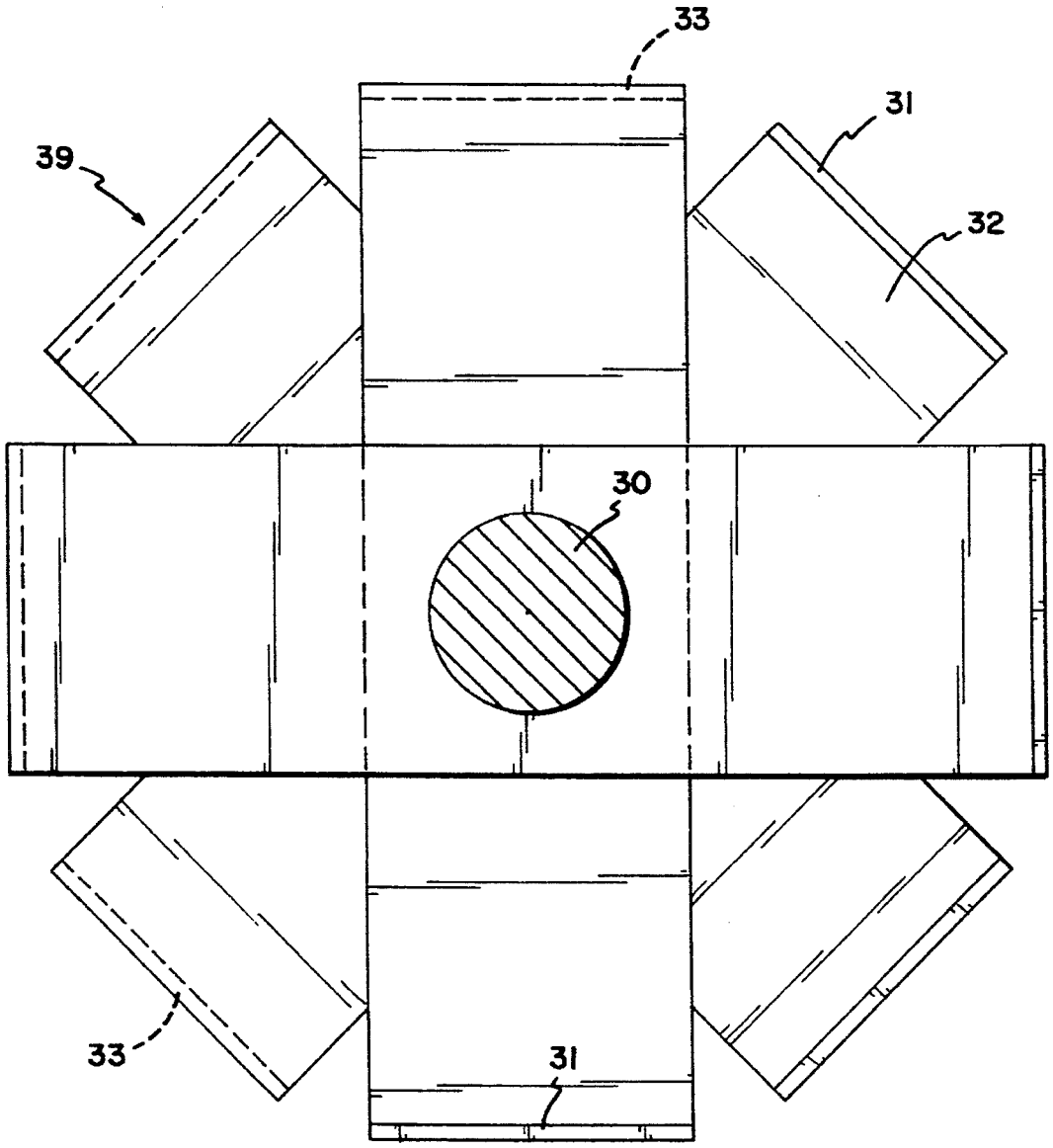
FIG. 4 is a top view of the plurality of blades that make up the Popper illustrating their positioning with respect to one another.

The Popper 4 comprises a set of rotating blades 32 that breaks the glass upon contact. More specifically, the Popper 4 comprises a plurality of blades arranged in fanned groups 39, as illustrated in FIG. 4, wherein a plurality of the fanned groups are fixedly attached and positioned at an equal distance from each other along a rotating shaft 30. Each blade 32, as illustrated in FIG. 3, is bent outward toward a first end 31 at an angle of about 90 degrees, forming a lip 38, and bent inward toward a second end 33 at an angle of about 90 degrees, forming a lip 36, and further having a hole 34 formed through its center through which a shaft 30 is placed and the blade 32 is fixedly connected.

Specifically, the plurality of blades arranged in fanned groups 39 are arranged in groups of four as shown in FIG. 4. Each blade 32 in the four blade fanned group 39 is positioned in relation to each other to form two cross shapes positioned such that all the first 31 and second 33 ends of each blade 32 are equally distant from each other, as shown in FIG. 4. FIG. 10 shows a top view of the open top end and the relationship of each fanned group of blades to one another. FIG. 4 illustrates that each cross shape is formed of two blades 32, each formed of ⅛ inch hot roll steel, positioned with one blade 32 on top of the other. The two cross shapes that make up the fanned group of four blades 39 are positioned at a distance from one another equal to lip 38.

As illustrated in FIG. 1, the shaft 30 having a first end 40 and a second end (not shown) extends through the center of the plurality of fanned groups of four blades 39, forming the Popper 4. The shaft 30 further extends through the housing Cabinet 7, where the shaft 30 first end 40 extends through a hole formed in the sidewall 5 and continues to extend through a pulley 88 having a hole formed in its center. The pulley 88 is fixedly connected to the shaft 30. The shaft 30 first end 40 further extends through a cover 90 attached to the housing cabinet 7 sidewall 5. The shaft 30 second end extends through a hole formed in the sidewall opposite sidewall 5 (not shown) of the housing cabinet 7. The second end is mounted in a ball bearing mounting block attached to the sidewall opposite sidewall 5 of the housing cabinet 7 (not shown). The ball bearing mounting block (not shown) allows for the free rotational movement of the shaft 30.

A belt 86 engages a pulley 84 fixedly attached to the crank shaft 74 of a first motor 82 and the pulley 88 fixedly attached to the shaft 30. The first motor 82, belt 86, and pulley 84 are positioned beneath a guard cover 90.

As shown in FIG. 2, the Popper region 100 has guiding blades 10 and 12 mounted across the housing (shown in FIG. 1) for making sure the glass as it is broken passes down through the housing cabinet into the Breaker region 102 where the Breaker 6 is located. The guiding blades 10 and 12 act as blockers to prevent glass fragments from flying out of the loading chute and open top end 2 as a result of the rotating Popper 4 kicking glass fragments back up and away from the Breaker 6 toward the guiding blades 10 and 12. The first guiding blade 12 further performs as a glass fragment sizing device allowing only glass fragments of about one-quarter inch (6 millimeters) to pass through an opening 14 defined by the distance between the guiding blade 12 and the blades 32 of the Popper 4. Guiding blades 10 and 12 are formed of a high carbon steel. Broken glass falls through the opening 14 until it reaches the Breaker region 102.

Figure 5:
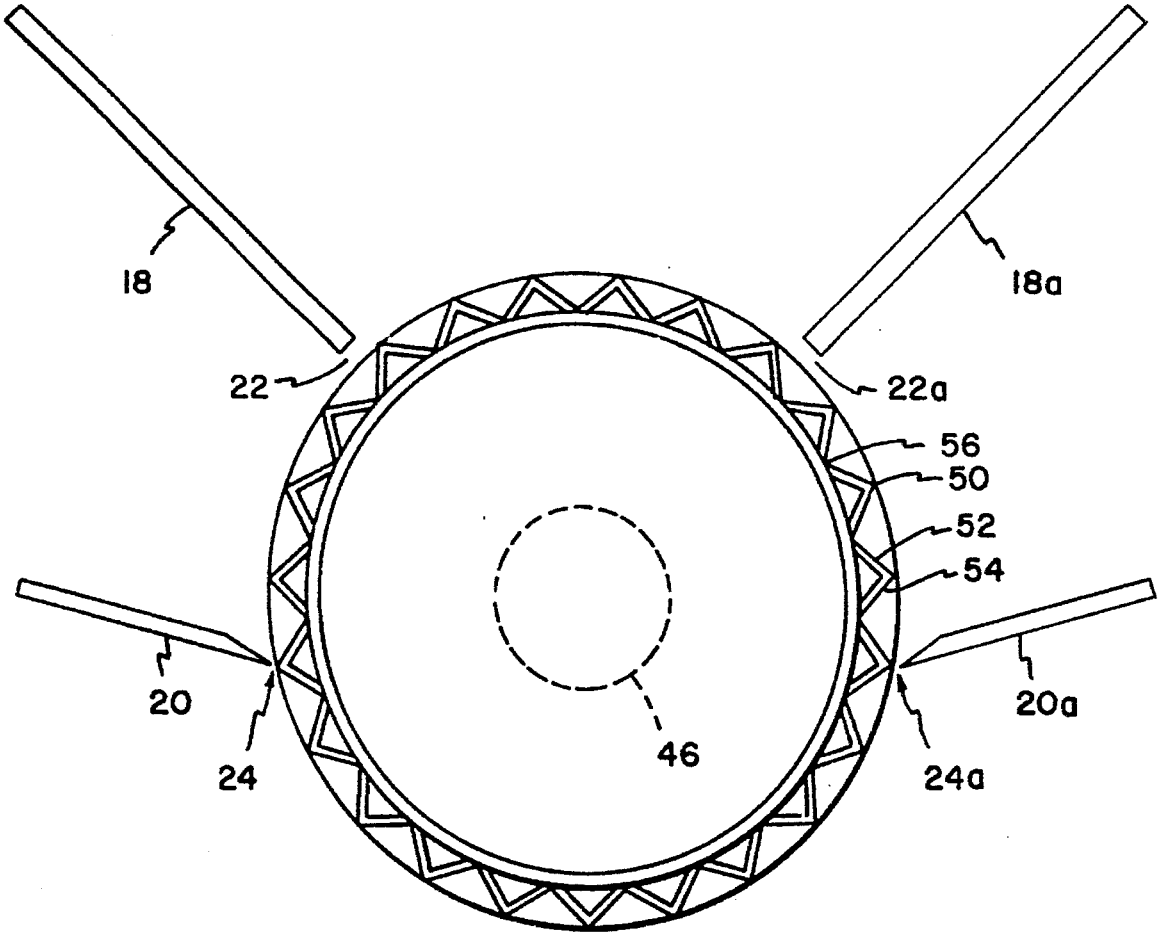
FIG. 5 is a side view of the Breaker illustrating the cutting edges positioning in relation to the Breaker.

The Breaker region 102, as illustrated in FIG. 2, positioned below the Popper region 100, is comprised of the Breaker 6, and four cutting blades, 18, 20, 18*a*, and 20*a*. More particularly, as illustrated in FIG. 5, the Breaker 6 is comprised of a rotating cylinder having a plurality of blades 50 attached to the cylinder outer periphery 56 wherein the blades 50 extend radially outward therefrom. The blades 50 on the Breaker 6 outer periphery surface 56 are formed by two flat sheets 52 and 54, made of a high carbon steel, extending radially outward until they converge.

The Breaker 6 has a shaft 46 that extends through its center. As illustrated in FIG. 1, the shaft 46 has a first end 48 and a second end (not shown). Shaft 46 first end 48 extends through a hole formed in the sidewall 5 of the housing cabinet 7, and further extends through a pulley 78. First end 48 further extends through the guard cover 90 that protects the belts, 86 and 80, and motor 82 that drive the Breaker 6 and Popper 4.

A belt 80 engages a pulley 84 fixedly attached to the crank shaft of a first motor 82 and the pulley 78. The belt 80 rotates the Breaker 6 which interacts with glass entering the Breaker 6 region 102 as it exits the Popper 4.

The shaft 46 second end (not shown) that extends from the center of the Breaker 6 extends through a hole formed in the sidewall opposite of sidewall 5 of the housing cabinet 7 (not shown), where the second end is mounted in a ball bearing mounting block attached to the sidewall opposite sidewall 5 of the housing cabinet 7. The ball bearing mounting block allows for the free rotational movement of the shaft 46.

As illustrated in FIGS. 2 and 5, when the Breaker 6 is rotating counter clockwise, the Breaker blades 50, made of a high carbon steel, interact with cutting blades 18 and 20, and shear the glass exiting from the Popper region 100. The Breaker blades 50 are positioned at an operative distance from the cutting blade 18 to form a first shearing gap 22 that shears pieces of glass down to a size of approximately one-quarter of an inch (or 6 millimeters) or smaller. Specifically, the distance between the Breaker blade 50 and cutting edge 18 is preferably one-quarter of an inch (or about 6 millimeters). The Breaker blades 50 are also positioned at an operative distance from the cutting blade 20 to form a second shearing gap 24 that further shears down the glass falling from the first shearing gap 22 into approximately one-eighth inch (or 3 millimeters) size glass pieces or smaller. Specifically, the distance between the Breaker blade 50 and cutting edge 20 is one-eighth inch (or 3 millimeters). The cutting edges 18*a* and 20*a* also act as a blocker to prevent glass from flying up through the Breaker region 102 as a result of the Breaker 6 counter-clockwise rotational movement.

When the Breaker is rotating in a clockwise direction, the cutting blades 18*a* and 20*a* perform the same function as cutting blades 18 and 20. Cutting blades 18*a* and 20*a* shears glass through interaction with the Breaker 6 in a manner that mirrors cutting blades 18 and 20 interaction with the Breaker 6. The Breaker blades 50 and the cutting blades 18*a* and 20*a* are operatively positioned in relation to each other to form first and second shearing gaps 22*a* and 24*a*.

The ability to rotate the Breaker 6 in both clockwise and counter clockwise directions is an important aspect of the present invention, permitting full use of the Breaker blades 50. As mentioned above, each Breaker blade 50 is formed on the outer periphery surface 56 of the Breaker 6 by two flat sheets 52 and 54 extending radially outward until they converge. This structure allows for the use of both sides 52 and 54 of the Breaker blades 50 for the purpose of shearing glass, thereby doubling the Breaker 6 useful life. Glass is a very hard substance, and as a result the Breaker blade 50 edges wear down over time. The ability to reverse the direction of the Breaker reduces Breaker replacement time and maintenance cost.

Figure 9:
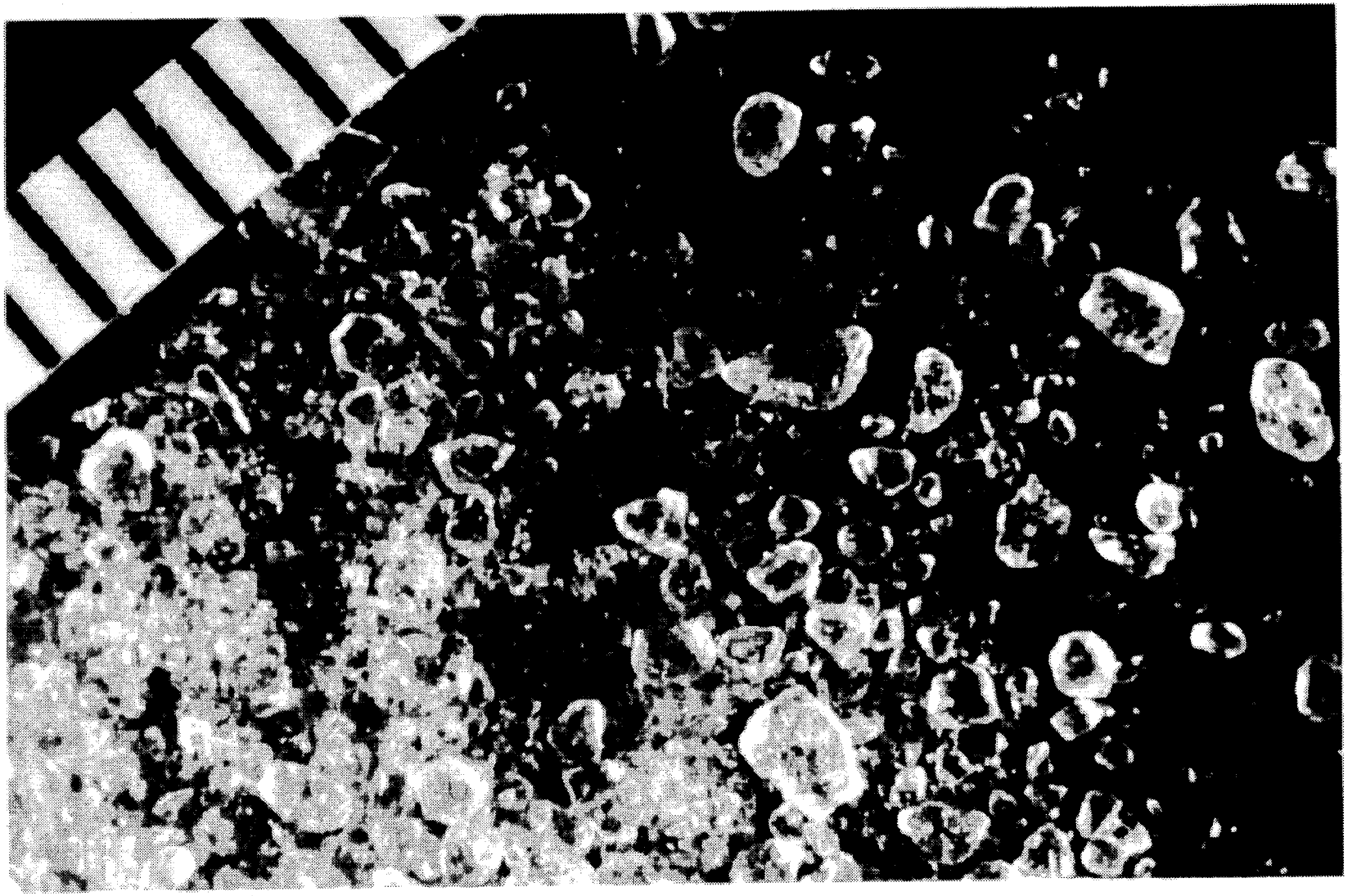
FIG. 9 is a color photograph showing actual sheared glass produced by the apparatus and method of the present invention.

As the glass that has been sheared down to approximately one-eighth of an inch (3 millimeters) or smaller exits the second shearing gap 24 or 24A of the Breaker region 102, it falls down into a shearing region 104 comprised of two Shearers 8. Each Shearer 8 is comprised of a screen 62 and a rotating tine arrangement 68 as illustrated in FIG. 1 (only one shown with panel removed). The tine arrangement 68 and screen 62 of the Shearer 8, interact with glass falling from the shearing gap 24 or 24*a* and shears these particles down to a particle size averaging about 0.75 millimeter, illustrated in FIG. 9 (millimeter chart shown on side of photo). However, those skilled in the art will readily recognize that the size of the resulting sheared particles are a function of the size of the holes in the shearing screen. As such, the average particle size is variable and can be made smaller or larger without departing from the scope of the present invention. The screen 62 is three-sixteenths of an inch (or 4.5 millimeters) thick, and is formed of a high carbon steel.

Figure 6:
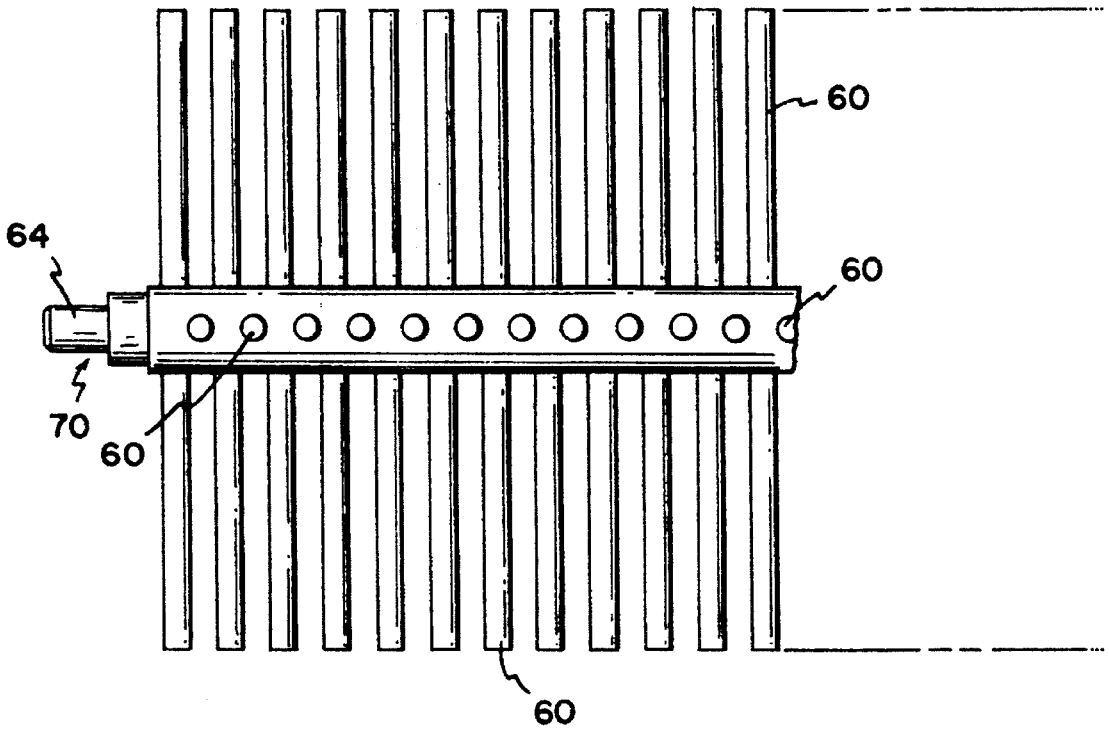
FIG. 6 is a vertical cross-section of the Shearer.
Figure 7:
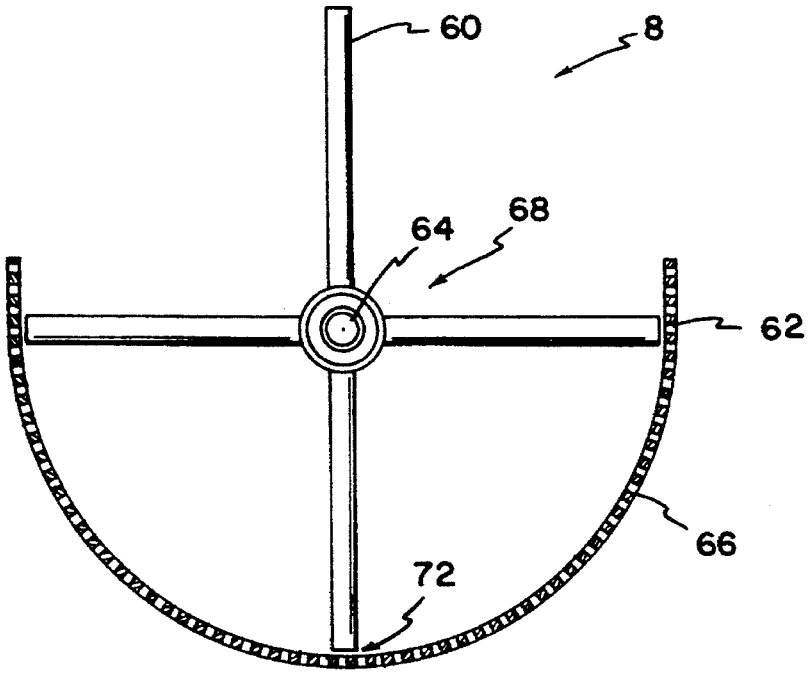
FIG. 7 is a side view of the Shearer illustrating its positioning in relation to the screen.

As illustrated in FIGS. 6 and 7, the tine arrangement 68 of each Shearer 8, is comprised of a shaft 64 having a plurality of tines 60 attached and extending outwardly therefrom. The tines 60 are arranged in rows, illustrated in FIG. 6, wherein there are four rows of tines 60 that outwardly extend from the shaft 64 forming a cross shape as illustrated in FIG. 7. However, those skilled in the art will readily recognize that the tines 60 and their positioning on the shaft 52 could be implemented in a myriad of ways without departing from the scope of the present invention. The tines are made of a high carbon steel.

The shaft 64 of the tine arrangement 68, having first 70 and second (not shown) ends extends through holes formed in the sidewalls of housing Cabinet 7. The shaft first end 70 extends through the sidewall 3 and a ball bearing mounting block 94 attached to the sidewall 3. The mounting block 94 allows for the free rotational movement of the shaft 64. Opposite the mounting block 94 and side wall 3 there is a side wall (not shown) having a hole through which the second end (not shown) of shaft 64 extends. The shaft 64 second end further extends through and is fixedly attached to a pulley (not shown) having a hole formed in its center. A belt engages the pulley and a pulley fixedly attached to the crank shaft of a second motor. The second motor has two belts attached to its crank shaft as there are two Shearers 8 that need to be rotated. The second motor, belts, and pulleys are positioned beneath a guard cover (not shown).

As illustrated in FIGS. 7 and 8, the tines 60 are at an operative distance 72 from the screen 62 and when rotating, shear the glass particles into smaller pieces, yielding a glass aggregate. The method of shearing is illustrated in FIG. 8, showing that when glass particles are sheared to a size dictated by the screen holes 66, they fall through the screen holes 66 and into the sheared glass holder 94.

As the glass particles descend through the shearing apparatus 1 through the Popper 100, Breaker 102, and Shearer 104 regions, the glass particles are being constantly hit by the rotating Popper blades 32, Breaker blades 50 and tines 60. The constant banging of the glass particles creates divots and reduces the sharpness of each particle. More importantly, this process causes the end glass aggregate to be porous, making it useful for many purposes.

One of the uses for which the glass aggregate may be used, is as a cheap substitute for sand. It is capable of performing many of the same tasks that sand can perform. In particular, the glass aggregate can be used as: a substitute for sand in sandblasting; a mortar for use in masonry and plastering, more particularly for use in making bricks, concrete block, concrete drain pipes, and concrete roads; a chip seal for roads (process where hot liquid tar is laid on top of approximately one-quarter inch (or 6 millimeters) of the aggregate to build up the road surface) in asphalt; a "grit", adding material for use in sand paper and polishing compounds; a "seepage prevention" material for use around pipes, basement footing, lake shore, and other areas that water or other liquid need not pass through; an "ice-grip" for securing footing on icy walk and road ways; a replacement for slate in shingling material, or Blast used in flat roofs; a glass making material by remelting and reforming glass out of the aggregate; and used for upgrading construction fill. The aggregate when used as an "ice-grip", not only provides traction for ice, but the transparency and reflectivity of the particles also allows sun to pass through and focus on the surface of the ice and accelerate melting.

An important property that the present invention provides for the glass aggregate it produces, is a consistency in particle size and a porousness in the surface of each particle. In particular, it has been found that 95% of the glass particles that make up the glass aggregate are of the same size and thereby provide consistency throughout the products in which they may be used.

The embodiment of the present invention disclosed above is for an industrial model, wherein a desired tonnage of glass particles per hour can be processed, depending on the speed at which the Popper Breaker and tine arrangement are rotating. As such, an important aspect of the present invention, that needs to be discussed, is the feed rate at which glass can be input into the inlet chute at the housing cabinet 7 open top end 2 by a conveyor that drops an assortment of glass therein.

In general, the feed rate is determined by the speeds at which the Popper 4, Breaker 6, and tine arrangement 68 of the Shearer 8 are rotating. These rotational speeds are dependent upon the size of the holes 66 in the screen 62 of the Shearer 8. Where a more fine particle is desired, the processing time is longer. Accordingly, the rate at which glass is input into the inlet chute at the open top end 2 of the housing cabinet 7 will be determined by the size of the shearing screens 62, the holes 66 therein, and the rate at which glass particles fall through the screen holes 66 after being sheared.

The rate at which the tine arrangement 68 rotates determines the rotational speed of the Breaker 6 and Popper 4. In all situations, the Breaker 6 rotational speed will be slower than that of the tine arrangement 68, and the speed at which the Popper 4 rotates will be equivalent to that of the Breaker 6, because they are both attached by belts to the first motor 82.

In addition to an industrial machine, there is also a model of the present invention that can be used in the homes of individuals (not shown). The shearing apparatus would essentially have the same structure as the industrial model, only it could omit the Popper 4 or Popper region 102, as disclosed in the industrial model above.

The model for use in homes would preferably be contained within a metal housing cabinet having a sidewall arrangement, an open top end and an open bottom end, wherein the open bottom end has a removable holding pan for covering the bottom end opening and capturing the sheared glass aggregate. The open top end has a door attached thereto for closing the apparatus inlet chute and to protect from flying glass shards which are dangerous to the user.

Upon dropping a bottle, jar, or other glass into the home glass shearing system, the glass would come into contact with a Breaker 4. The Breaker 4 would not be rotating, and does not rotate when the door covering the open top end is not in a closed position. Upon closing the door, and turning the apparatus on, the glass is broken and its pieces are sheared in a manner exactly as that disclosed above in the industrial model, with the exception of the breaking of glass that occurs in the Popper region 100.

More specifically, the glass is broken down in two stages, in a Breaker region and a Shearer region which are the same as the Breaker 102 and Shearer 104 regions disclosed above. In the Breaker region in the non-industrial model, there is interaction of the Breaker and a first cutting edge which forms a first shearing gap similar to the one disclosed above, where the glass is sheared down to a size of one-quarter of an inch (or 6 millimeters). As glass exits the first shearing gap, it interacts with the Breaker and a second cutting edge which form a second shearing gap similar to the one disclosed above where the glass is sheared down to a size of one-eighth of an inch (or 3 millimeters). Upon exiting the second shearing gap of the Breaker region, the sheared glass particles fall to the screen of the Shearer. The Shearer is comprised of a shearing screen and a tine arrangement, disclosed in FIGS. 6 and 7. The glass that falls to the shearing screen, is sheared through the operative interaction of the shearing screen and the tine arrangement, illustrated in FIG. 8. The sheared glass aggregate falls into a holding pan and can easily be removed and disposed of or in the alternative used for many of the manners described above.

It will be understood that the structure of the Glass Shearing Apparatus of the present invention is not limited to the particular constructions and arrangements of parts herein illustrated and described, but embraces all modification of the present invention that come within scope of the following claims.

What is claimed:

1. An apparatus for shearing discarded glass products into a glass aggregate comprising:

a housing having a sidewall arrangement, an open top end, an open bottom end, and a receptacle releasably mounted under said open bottom end, wherein said open top end of said housing provides an access for loading discarded glass products;

a rotating Popper mounted within said housing below said open top end for breaking said glass, said Popper including a plurality of blades;

at least two Popper guiding blades, wherein said guiding blades are mounted and arranged at an operative distance from said Popper for guiding glass product into the rotating Popper blades wherein the Popper breaks the glass product into smaller pieces;

a rotating Breaker positioned below said Popper, wherein said Breaker is mounted to said housing and comprises a cylinder having a plurality of blades attached to an outer surface of said cylinder and extending radially therefrom, wherein said Breaker interacts with at least two cutting blades for shearing glass exiting from said Popper into smaller pieces; and a Shearer mounted to said housing and positioned below said Breaker, wherein said Shearer comprises rotating tines and a screen, wherein said tines extend from a rotating shaft to interact with said glass exiting said breaker and said screen to shear said glass exiting said Breaker into tiny glass particles.

2. The apparatus of claim 1 wherein each of said blades of said Popper is bent inward toward a first end at an angle, and bent outward toward a second end at an angle.

3. The apparatus of claim 1 wherein each of said plurality of blades of said breaker attached to and extending outwardly from said outer surface of said cylinder are each formed by two flat sheets extending radially outward from said outer surface of said cylinder until they converge.

4. The apparatus of claim 1 having a receptacle positioned below said screen of said Shearer at said open bottom end of said housing for catching said tiny pieces of glass particles that fall through said screen.

5. The apparatus of claim 1 wherein said tiny pieces of glass particles form a glass aggregate, each said tiny piece of glass has a consistency in particle size and a porousness in the surface of each particle.

* * * * *